US007278626B1

(12) United States Patent
Chang

(10) Patent No.: US 7,278,626 B1
(45) Date of Patent: Oct. 9, 2007

(54) ADJUSTABLE PRYING BAR

(76) Inventor: Pi-Hsia Chang, P.O. Box 697, Fongyuan City, Taichung County (TW) 420

( * ) Notice: Subject to any disclaimer, the term of this patent is extended or adjusted under 35 U.S.C. 154(b) by 0 days.

(21) Appl. No.: 11/492,874

(22) Filed: Jul. 26, 2006

(30) Foreign Application Priority Data

Jan. 12, 2006 (TW) ..... 95200711 U

(51) Int. Cl.
*B25C 11/00* (2006.01)
*B66F 15/00* (2006.01)

(52) U.S. Cl. ..... 254/25; 81/177.9

(58) Field of Classification Search ..... 254/25, 254/27, 129, 131; 81/177.9, 177.8, 177.7, 81/58.3

See application file for complete search history.

(56) References Cited

U.S. PATENT DOCUMENTS 458,337 A * 8/1891 Dodge ..... 81/176.1
1,375,751 A * 4/1921 Grannis ..... 254/25
2,189,480 A * 2/1940 Tessier ..... 254/131
2,376,978 A * 5/1945 Pate ..... 254/131
2,379,387 A * 6/1945 Tessier ..... 254/131
2,921,773 A * 1/1960 Bruce ..... 254/129
4,939,961 A * 7/1990 Lee ..... 81/60
5,595,095 A * 1/1997 Hillinger ..... 81/58.3
5,871,204 A * 2/1999 Spirer ..... 254/26 R
5,875,692 A * 3/1999 Lin ..... 81/58.3
6,158,308 A * 12/2000 Huang ..... 81/58.3
6,253,645 B1 * 7/2001 Lin ..... 81/58.3
6,339,977 B1 * 1/2002 Lee et al. ..... 81/58.3

* cited by examiner

*Primary Examiner*—Joseph J. Hail, III

(57) ABSTRACT

An adjustable prying bar includes a prying head having an arcuate body, a flat tipped lower end a lug at upper end wherein the lug has a circular depression and an inverse stop ring on upper portion and inner thread on lower portion, a handle rotatably engaged with the upper end of the prying head having flat front end with a hexagon hole therein engaged within the lug of the prying head, and a checking mechanism including an upper cover, a lower cover, a hexagon plate and a spring separately engaged with the lug and the hexagon hole of the handle wherein the hexagon plate has a stop ring engageable with stop ring of the lug. Thereby, the angle between the prying head and the handle enables to adjust for larger or smaller than 90 degrees.

3 Claims, 5 Drawing Sheets

ADJUSTABLE PRYING BAR

BACKGROUND OF THE INVENTION

The present invention relates to the prying tools and more particularly to an adjustable prying bar which has an upper and lower portions rotatably engaged with each other so as to pry the working object to a highest extent.

As we know, a prying bar can be use to automobile maintenance and/or to pry variety of objects. Conventional prying bar has a prying head perpendicularly and solidly connected to a handle to form an angle about 90 degrees, and couldn't make angular adjustment. So that it could only pry an object to a predetermined height and couldn't make the object a little higher. Sometimes it even couldn't pry up the object. So it causes great inconvenience to the user.

SUMMARY OF THE PRESENT INVENTION

The present invention has a main object to provide an adjustable prying bar which has upper and lower checking devices capable of rotating the handle to a more large angle in order to pry the working object up to a required height.

Accordingly the adjustable prying bar comprises a prying head perpendicularly connected to the handle. The prying head has an arcuate body having a flat tipped front end and a lug at a rear end, whereas the handle has at front end a hexagon through hole enabling to insert into the lug of the prying head. The lug has a circular depression in a upper portion including an internal stopping ring on the opposite side of the depression. A checking mechanism has a hexagon plate embedded into the hexagon through hole of the handle having a stop ring engaging with the internal stop ring of the prying head, an upper cover covers the circular depression of the lug and then engages with the hexagon plate, a lower cover screws with the lower portion of the lug, a spring engages between the hexagon plate and the lower cover to provide resilient force therein.

Thereby, the handle can be able to turn up to make the hexagon plate idle running a distance for adjusting a larger angle between the handle and the prying head. Then press the handle downward to rotate the hexagon plate so that the hexagon plate be engaged with the stop ring inside the lug. Therefore the prying head begins to work to pry up a working object to a largest height.

The present invention will become more fully understood by reference to the following detailed description thereof when read in conjunction with the attached drawings.

DETAILED DESCRIPTION OF THE PREFERRED EMBODIMENT

Figure 1:
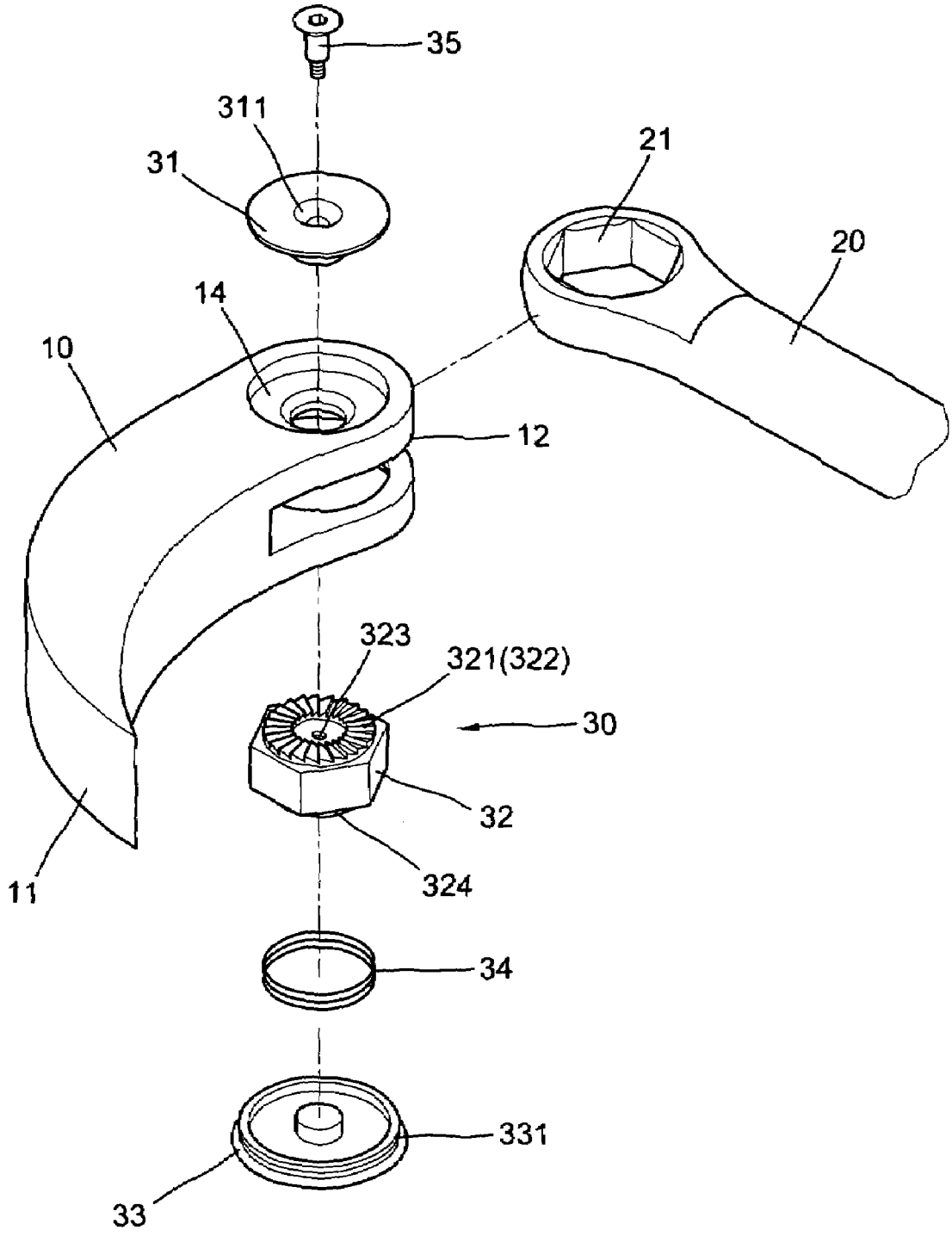
FIG. 1 is an exploded perspective view to show the preferred embodiment of a prying bar of the present invention.
Figure 2:
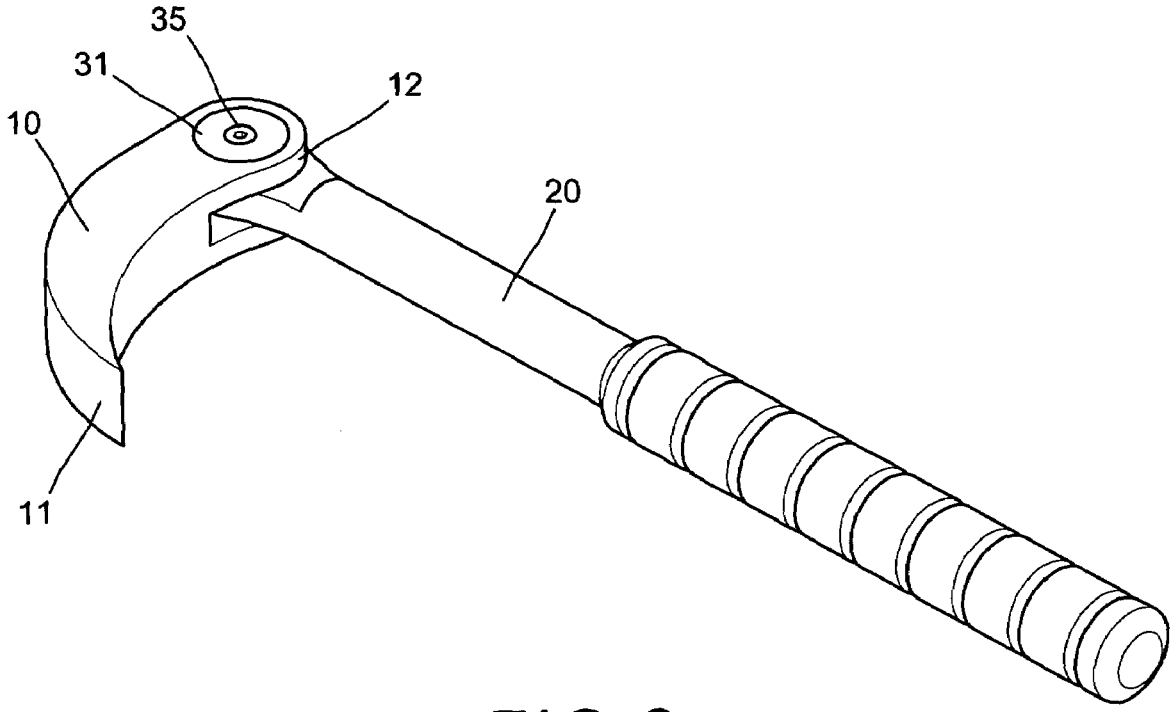
FIG. 2 is a perspective view to show the assembly of FIG. 1.
Figure 3:
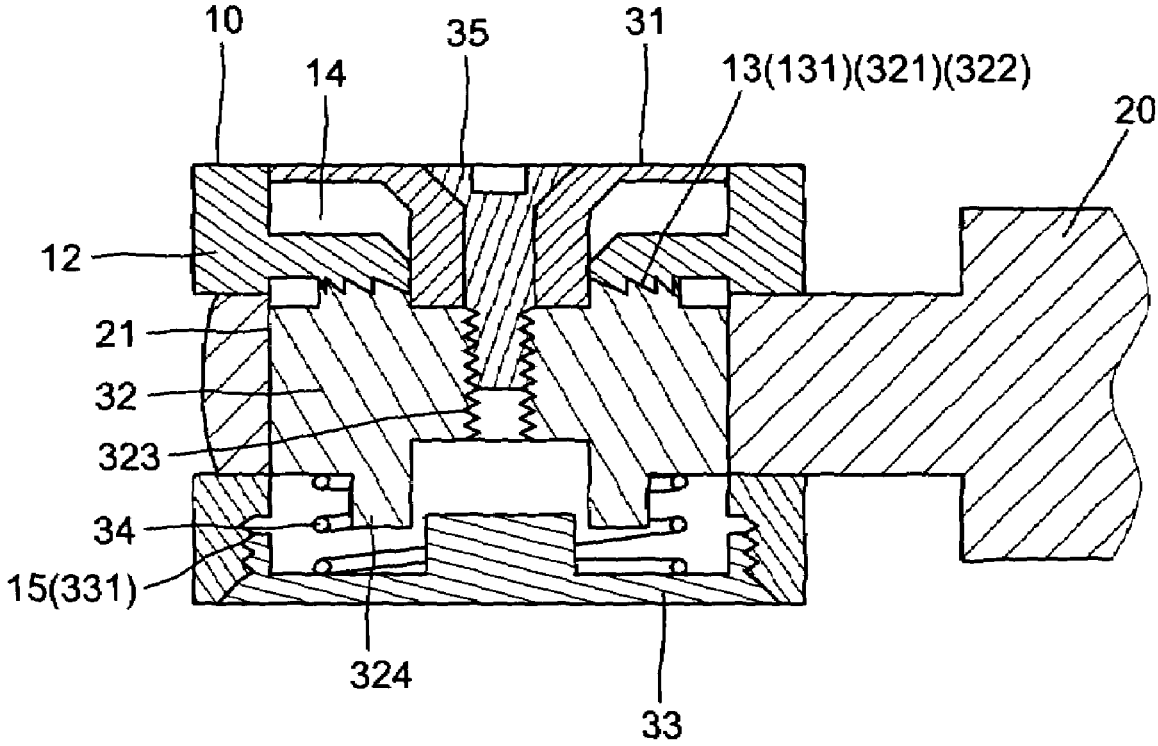
FIG. 3 is a sectional view to show the detailed engagement of the checking mechanism.

With reference to the drawings and initiated from FIGS. 1 to 3, the prying bar of the present invention comprises generally a prying head 10, a handle 20 and a checking mechanism 30.

The prying head has an arcuate body, a flat tipped lower end 11 and a lug 12 at upper end, wherein the lug 12 has a circular depression 14 with a central bore in the top of upper portion, a internal stop ring 13 on opposite side of the depression 14, the internal stop ring 13 has a plurality of radially inverse teeth 131 therearound, a large aligned through hole in the lower portion of the lug 12 having inner threads around inner periphery.

The handle 20 has a hexagon hole 21 in the flat front end engaged within the lug 12 of the prying head 10 therebetween.

The checking mechanism 30 comprises an upper cover 31 engaged within the circular depression 14 of the lug 12 including a central bore 311, a screw 35 inserted through the central bore 311 of the upper cover 31 and engaged with a threaded central bore 323 of a hexagon plate 32 which is engaged within the hexagon hole 21 of the handle 20 and having a stop ring 321 on upper surface formed with a plurality of positive radial teeth 322 engageable with the stop ring 13 of the lug 12, a circular ring 324 on the bottom for engaging with a spring 34 thereon, a lower cover 33 covering the outside of the lower portion of the lug 12 having external threads on a circular ring 331 engaged with the inner threads 15 of the lug 12 and a cylindrical projection on upper center for engaging with the lower end of the spring 34 which is functioned to provide resilience to the hexagon plate 32 when it is in idle running.

Figure 4:
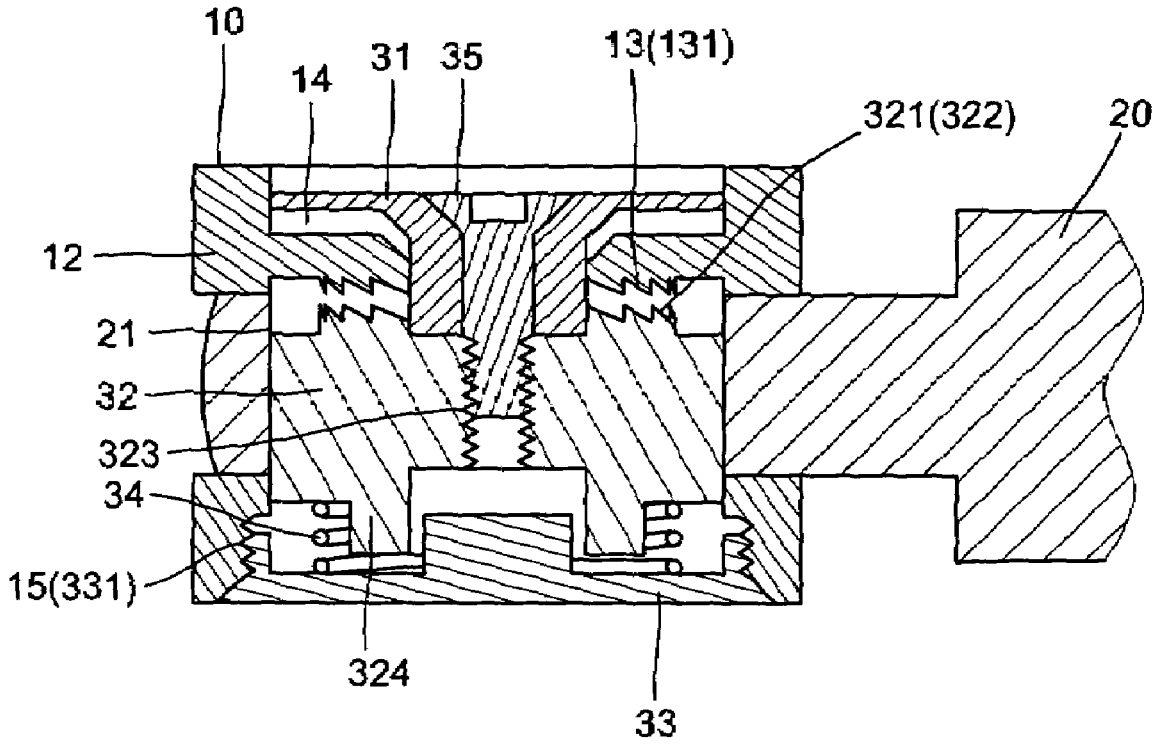
FIG. 4 is a sectional view to show the teeth of the hexagon plate being engaged with inner teeth on the upper portion of the lug.
Figure 5:
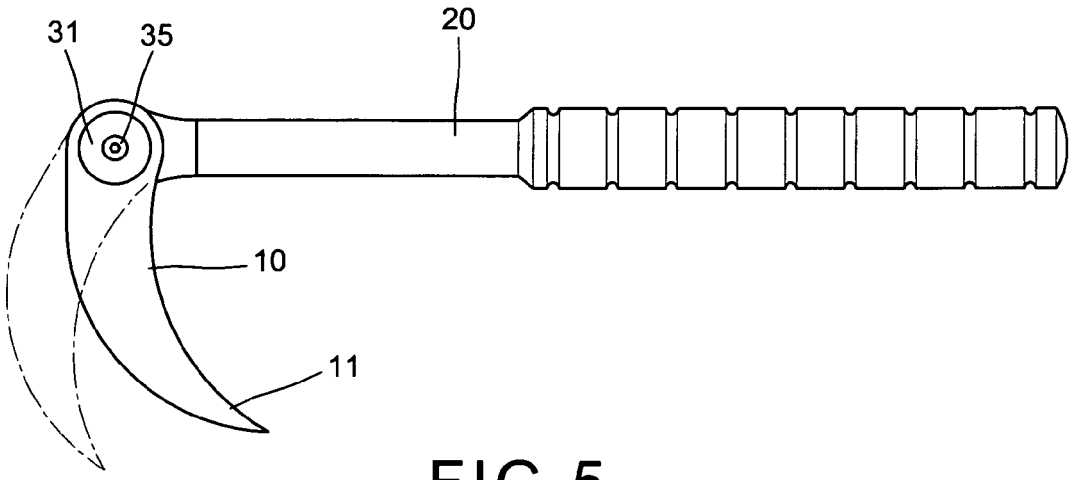
FIG. 5 is a plane view to show the angle adjustment between the prying head and the handle.

Referring to FIGS. 4 and 5 and FIG. 3 again, in operation the user first adjusts the angle between the prying head 10 and the handle 20 by lifting the handle upward to make idle running while the stop rings 13 and 321 are disengaged and the spring 34 is pressed by the hexagon plate 32 to retreat to store resilient force until the angle between the prying head 10 and the handle 20 becoming larger than 90 degrees, press down the handle 20, then the stop rings 13 and 321 be engaged again because of the resilience of the spring 34 and then inserts the flat stipped lower end of the prying head into the gap between a working object and the ground and press again the handle 20 downward to make the gap into largest extent, so the object becomes more easy to move, of cause the angle between the prying head 10 and the handle 20 may be adjusted larger or smaller than 90 degrees depending upon the requirement of the user. Further, the shape of the hexagon hole and the hexagon plate may change to rectangular.

Note that the specification relating to the above embodiment should be construed as an exemplary rather than as a limitative of the present invention, with many variations and modifications being readily attainable by a person of average skill in the art without departing from the spirit or scope thereof as defined by the appended claims and their legal equivalents.

I claim:

1. An adjustable prying bar comprising:

a prying head having an arcuate body, a flat tipped lower end, a lug at upper end wherein said lug has a circular depression with a small central bore in a upper portion and a stop ring formed with a plurality of inverse radial teeth on opposite side of said depression, and a large central bore in a lower portion having thread on inner periphery;

a handle having a flat front end engaged with the lug of said prying bar including a hexagon hole therein;

a checking mechanism disposed in said lug for facilitating said prying bar to perform angle adjustment between said prying head and said handle.

2. The adjustable prying bar as recited in claim 1 wherein said checking mechanism comprising;

an upper cover covering the circular depression of said lug having a small central bore and secured by a screw;

a hexagon plate engaged into the hexagon hole of said handle having a stop ring formed with a plurality of positive radial teeth engageable with the stop ring of said lug and a circular ring projected downward from a center of bottom;

a lower cover covering lower portion of said lug having outer threads on a circular wall engaged with the threads on inner periphery of said lug and a cylindrical projection on upper center of bottom;

a spring engaged between said hexagon plate and said lower cover and wrapped on said circular ring in said cylindrical projection.

3. The adjustable prying bar as recited in claim 1 wherein the angle between said prying head and said handle may be adjusted for larger or smaller than 90 degrees.

* * * * *